US011220836B2

(12) United States Patent
Yoo et al.

(10) Patent No.: US 11,220,836 B2
(45) Date of Patent: Jan. 11, 2022

(54) DOOR LOCK MORTISE

(71) Applicant: SAMSUNG SDS CO., LTD., Seoul (KR)

(72) Inventors: Sung-Won Yoo, Seoul (KR); Sang-Han Lee, Seoul (KR)

(73) Assignee: SAMSUNG SDS CO., LTD., Seoul (KR)

( * ) Notice: Subject to any disclaimer, the term of this patent is extended or adjusted under 35 U.S.C. 154(b) by 733 days.

(21) Appl. No.: 16/015,765

(22) Filed: Jun. 22, 2018

(65) Prior Publication Data

US 2018/0371792 A1 Dec. 27, 2018

(30) Foreign Application Priority Data

Jun. 22, 2017 (KR) ..... 10-2017-0079334

(51) Int. Cl.

| | |
|---|---|
| ***E05B 13/00*** | (2006.01) |
| ***E05B 59/00*** | (2006.01) |
| ***E05B 47/00*** | (2006.01) |
| *E05B 17/20* | (2006.01) |
| *E05B 63/00* | (2006.01) |

(52) U.S. Cl.

CPC ..... *E05B 13/004* (2013.01); *E05B 47/0012* (2013.01); *E05B 59/00* (2013.01); *E05B 17/20* (2013.01); *E05B 63/0065* (2013.01)

(58) Field of Classification Search

CPC .... E05B 13/004; E05B 47/0012; E05B 59/00; E05B 17/20; E05B 63/0065

See application file for complete search history.

(56) References Cited

U.S. PATENT DOCUMENTS 5,495,731 A * 3/1996 Riznik ..... E05B 63/16 292/39
9,416,567 B2 * 8/2016 Ji ..... E05B 47/026

(Continued)

FOREIGN PATENT DOCUMENTS

CN 102191890 A 9/2011
CN 104818904 A * 8/2015

(Continued)

OTHER PUBLICATIONS

Communication dated Aug. 14, 2020 by the State Intellectual Property Office of P.R. China in counterpart Chinese Patent Application No. 201810653171.2.

(Continued)

*Primary Examiner* — Kristina R Fulton
*Assistant Examiner* — James Edward Ignaczewski
(74) *Attorney, Agent, or Firm* — Sughrue Mion, PLLC

(57) ABSTRACT

Provided is a door lock mortise. The door lock mortise includes a structure in which a latch fixing member moves between a latch operating member and a latch cover member when a dead bolt is locked or unlocked. According to the embodiments of the present invention, the door lock mortise including the latch fixing member to have a structural characteristic capable of addressing a problem in that a latch bolt may be moved when the dead bolt is unlocked to release a door lock so that an impact is transmitted only to the dead bolt in a state in which the dead bolt is not unlocked and durability is reduced is disclosed.

14 Claims, 5 Drawing Sheets

(56) References Cited

U.S. PATENT DOCUMENTS

| | | | | |
|---|---|---|---|---|
| 2006/0266088 | A1* | 11/2006 | Lee | E05B 59/00 70/107 |
| 2011/0175373 | A1* | 7/2011 | Ding | E05B 59/00 292/144 |
| 2014/0252780 | A1 | 9/2014 | Maeng et al. | |
| 2018/0112438 | A1* | 4/2018 | Guma | E05B 9/02 |
| 2018/0320414 | A1* | 11/2018 | Piantek | E05B 63/202 |
| 2019/0071902 | A1* | 3/2019 | Uyeda | E05C 9/10 |

FOREIGN PATENT DOCUMENTS

| | | | | | |
|---|---|---|---|---|---|
| CN | 104818904 | A | | 8/2015 | |
| CN | 106639670 | A | * | 5/2017 | |
| CN | 106639670 | A | | 5/2017 | |
| EP | 1683936 | A1 | * | 7/2006 | E05B 63/16 |
| EP | 3299546 | A1 | * | 3/2018 | E05B 63/16 |
| JP | 2006-83590 | A | | 3/2006 | |
| KR | 10-2009-0088178 | A | | 8/2009 | |
| KR | 10-2011-0135078 | A | | 12/2011 | |
| KR | 10-2012-0115778 | A | | 10/2012 | |
| KR | 20120115778 | A | * | 10/2012 | |
| KR | 10-1626120 | B1 | | 5/2016 | |
| WO | WO-2017046445 | A1 | * | 3/2017 | E05B 53/00 |

OTHER PUBLICATIONS

Communication dated Dec. 24, 2020, issued by the Korean Intellectual Property Office in counterpart Korean Patent Application No. 10-2017-0079334.

* cited by examiner

[FIG. 1]
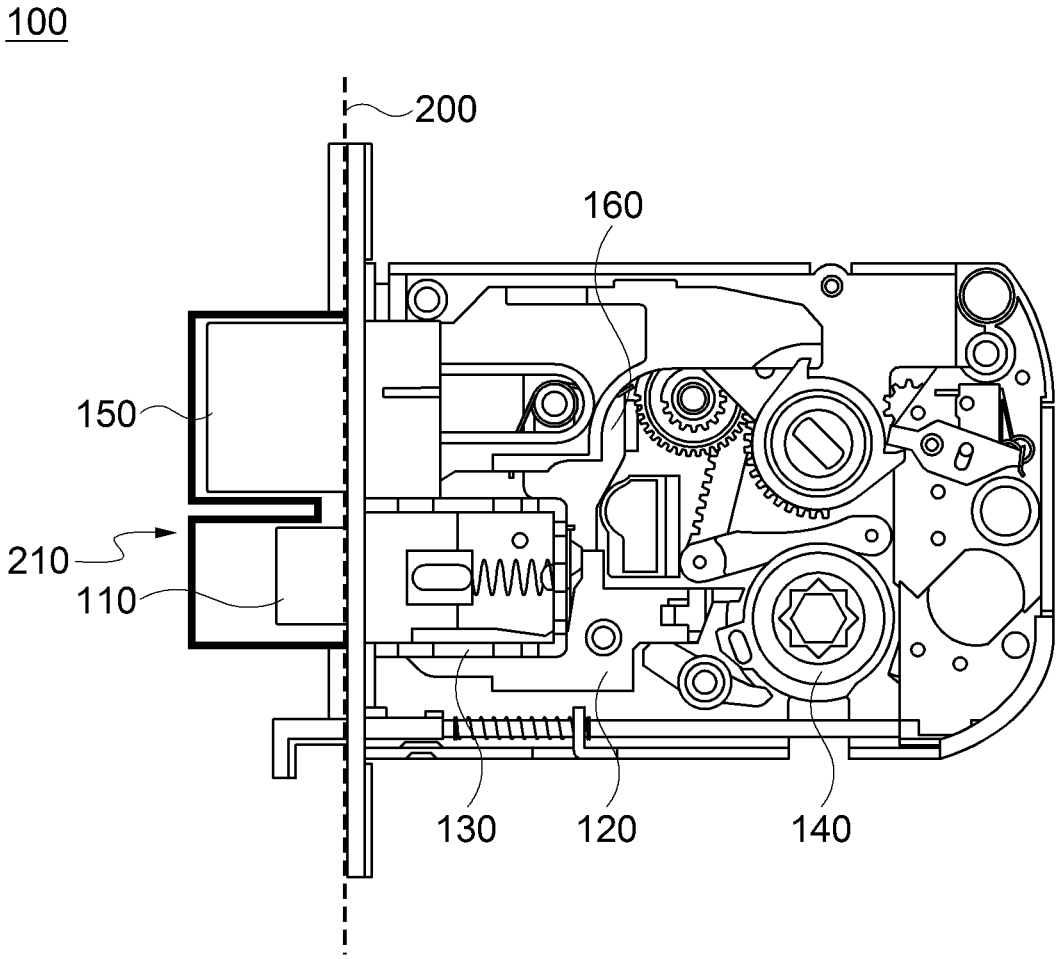

[FIG. 2]
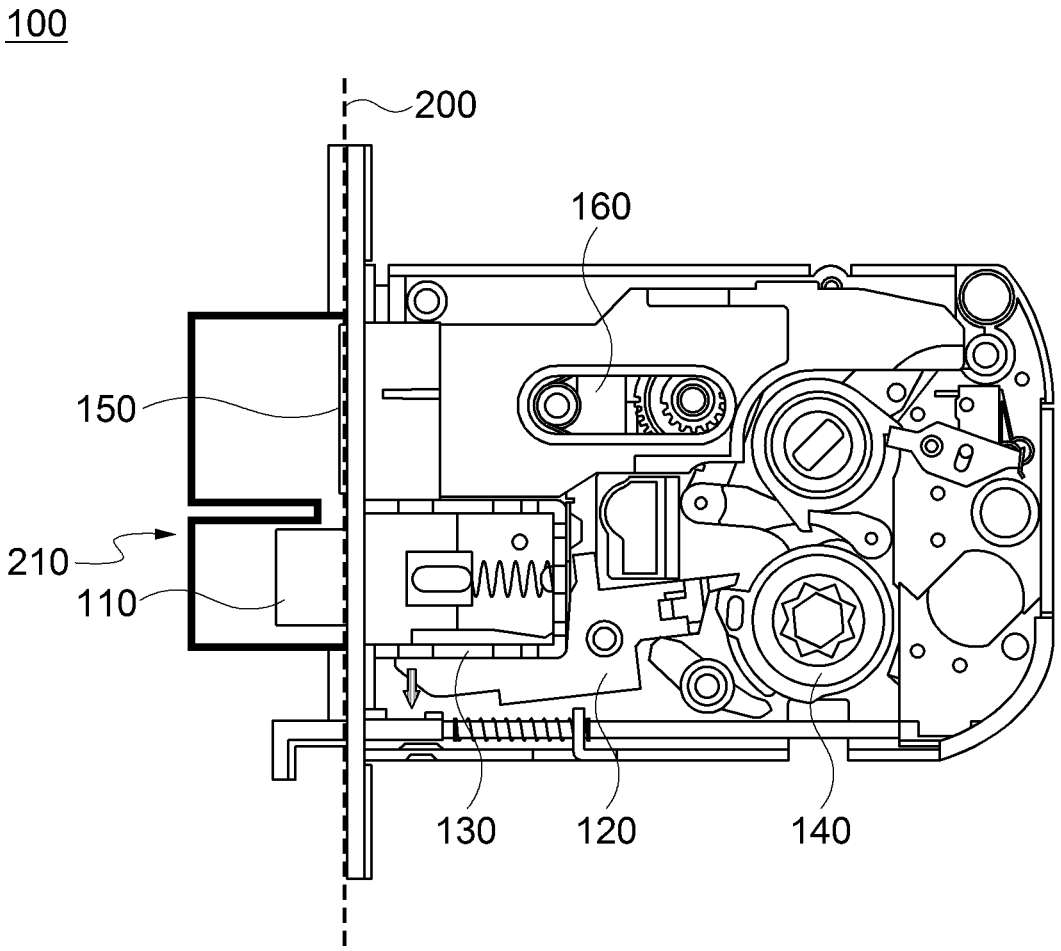

[FIG. 3]
100
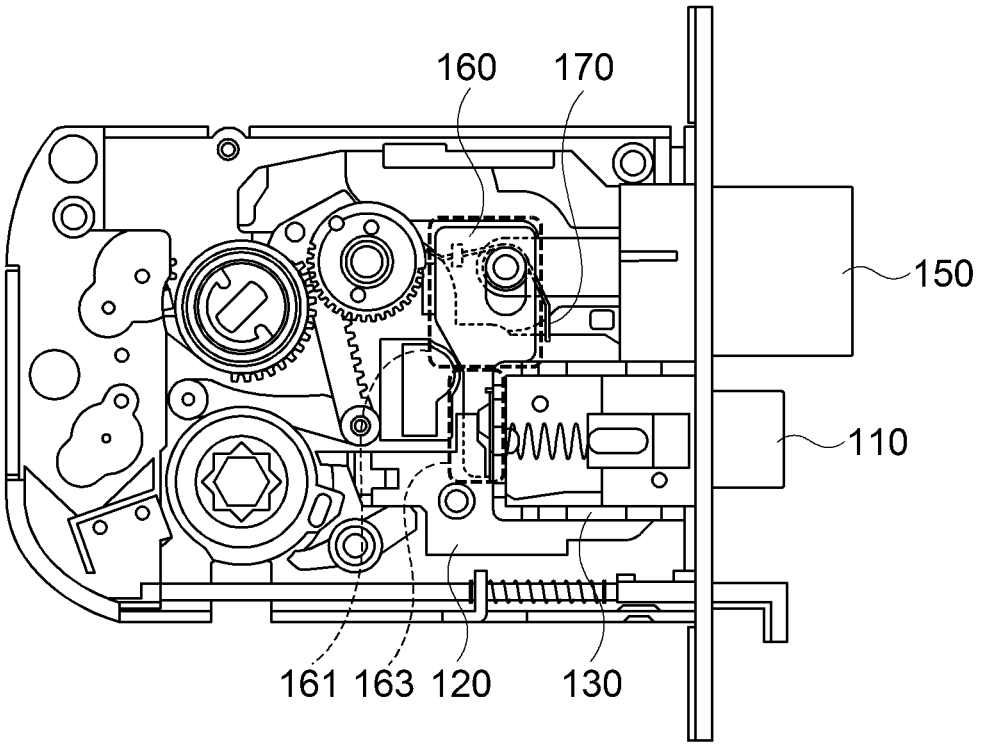

[FIG. 4]
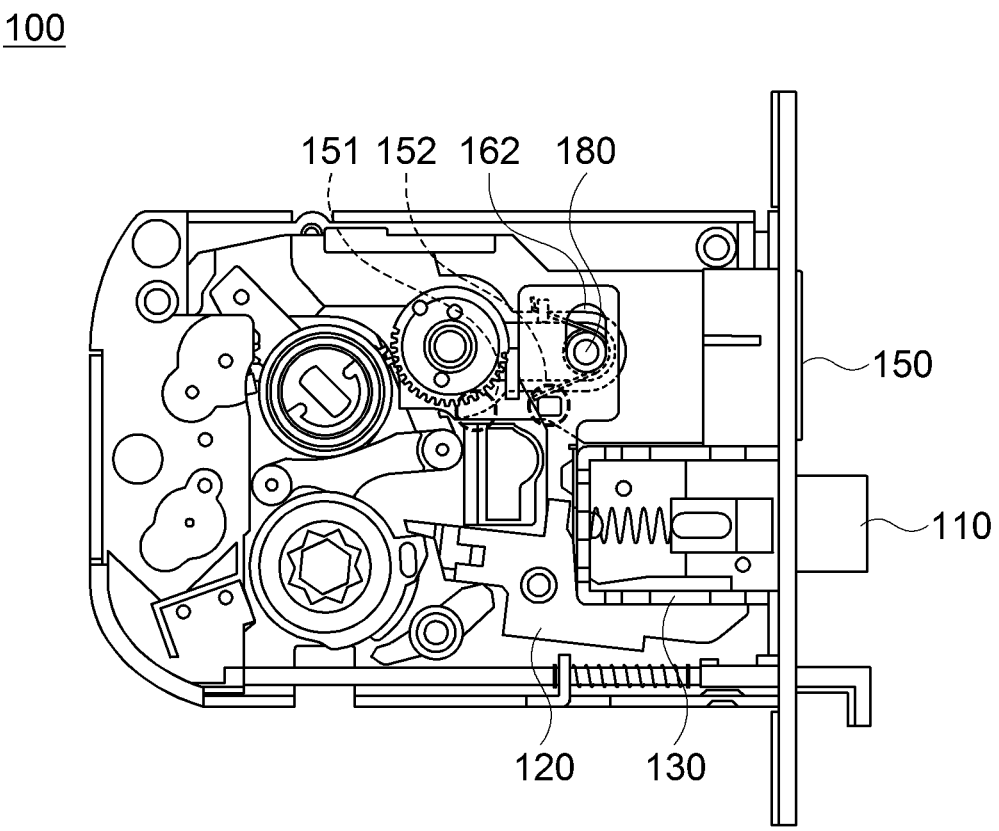
[FIG. 5]
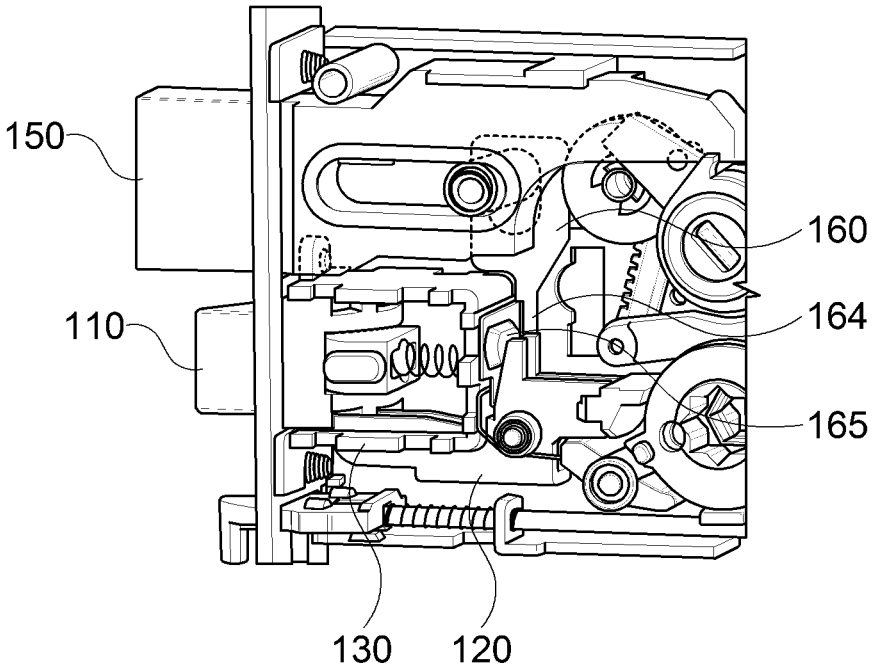

[FIG. 6]
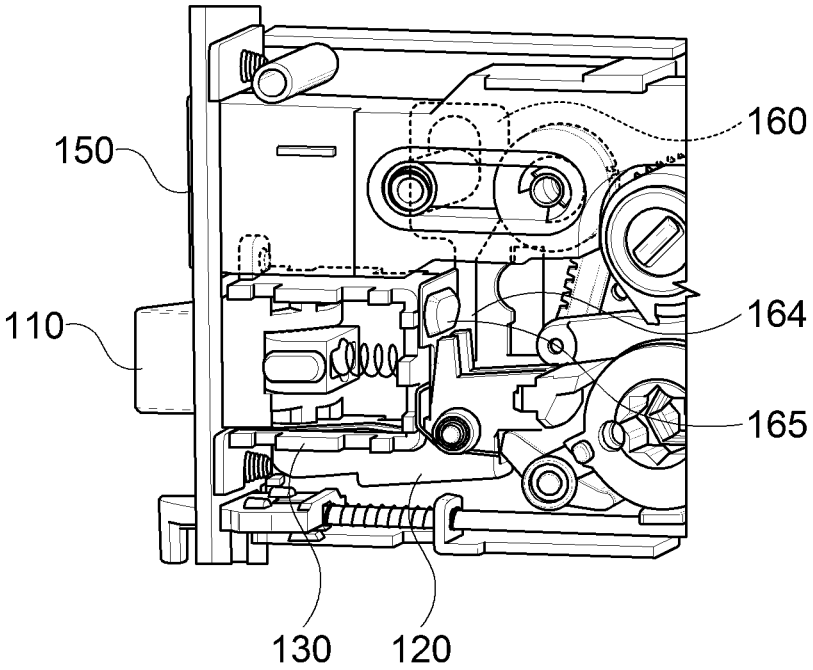

DOOR LOCK MORTISE

CROSS-REFERENCE TO RELATED APPLICATION

This application claims priority to and the benefit of Korean Patent Application No. 10-2017-0079334, filed on Jun. 22, 2017, the disclosure of which is incorporated herein by reference in its entirety.

BACKGROUND

1. Field of the Invention

The present invention relates to a door lock mortise.

2. Discussion of Related Art

A door lock is a device that locks and unlocks a door according to whether a latch bolt and a dead bolt, which are installed on the door and protrude and enter a side surface of the door, are discharged. A latch bolt is a unit for preventing a door from being automatically opened, and is not a locking unit.

A mortise lock having a lock structure due to a latch bolt and a dead bolt is being widely used to address an unstable situation of only the latch bolt.

A digital door lock allows a dead bolt to be released by power of a motor. The digital door lock is convenient when a user forgets to lock a door because the digital door lock can automatically move the dead bolt to a locked position through the power of the motor after the door is closed.

Meanwhile, in the case in which a user has to rapidly escape through a door in an emergency such as a fire or the like, separately releasing a dead bolt interferes with the door opening and the rapid escape, and thus a digital door lock having a so-called anti-panic function in which a latch bolt and a dead bolt are simultaneously unlocked by just manipulating an indoor lever is widely used.

However, in a conventional digital door lock including Korean Utility Model Registration Application No. 20-2011-0006836 of the present applicant, in a process in which a latch bolt and a dead bolt are unlocked by manipulating an indoor lever, the latch bolt enters an inside of the door lock first and the dead bolt enters later.

In the conventional door lock, when a user leaves a room while simultaneously rotating and pushing the indoor lever and the latch bolt enters the inside of the door lock mortise first and the dead bolt has not yet fully entered the door lock mortise, the dead bolt is caught and the opening of the door is occasionally interrupted.

In addition, when the door is operated by rotating an outdoor lever in a state in which the dead bolt is not unlocked, the latch bolt enters the inside of the door lock and the dead bolt is fixed, and thus an impact is transmitted only to the dead bolt and durability is reduced.

Document of Related Art

[Patent Document]

Korean Utility Model Registration Application No. 20-2011-0006836 (Jul. 27, 2011)

SUMMARY OF THE INVENTION

The present invention is directed to a door lock mortise including a latch fixing member which moves between a latch operating member and a latch cover member when a dead bolt is locked or unlocked in order to lock or unlock a door lock.

According to an aspect of the present invention, there is provided a door lock mortise including a latch bolt inserted into a striker of a door frame and configured to maintain a door in a closed state, a latch operating member rotatably operated to release the latch bolt, a latch cover member formed to surround the latch bolt, a latch operating member manipulating portion rotated by an indoor or outdoor operating unit and configured to rotate the latch operating member, a dead bolt inserted into the striker of the door frame and configured to maintain the door in a locked state, and a latch fixing member configured to move between the latch operating member and the latch cover member when the dead bolt is locked or unlocked.

Further, the latch fixing member may be inserted between the latch operating member and the latch cover member by being moved upward and downward, leftward and rightward, or backward and forward.

Further, the latch fixing member may be inserted between the latch operating member and the latch cover member by being rotated.

Further, the latch fixing member may include a mounting portion having a groove portion into which a fixing member passing through the dead bolt is inserted, and a fixing portion configured to extend to one side of the mounting portion and inserted between the latch operating member and the latch cover member.

Further, the fixing portion may include a parallel portion configured not to be in contact with one end portion of the latch cover member, and a locking portion configured to protrude between the latch operating member and the latch cover member to be perpendicular to the parallel portion.

Further, the door lock mortise may have a structure in which the dead bolt is inserted and moved into the striker of the door frame when the dead bolt is locked, and enters into and moves in a direction of an inside of the door lock mortise when the dead bolt is unlocked, one end portion of an elastic member located at the dead bolt in a non-fixed state may rotate clockwise or counterclockwise, and the latch fixing member in which the other end portion of the elastic member is located is moved upward and downward in response to the rotation of the elastic member.

Further, the door lock mortise may have a structure in which the dead bolt includes a first locking protrusion portion and a second locking protrusion portion which are in contact with the one end portion of the elastic member, the elastic member is rotated by movement of the first locking protrusion portion when the dead bolt is unlocked, and the elastic member is rotated by movement of the second locking protrusion portion when the dead bolt is locked.

Further, the door lock mortise may have a structure in which the latch fixing member is moved upward in response to the rotation of the elastic member when the dead bolt is unlocked, and the latch fixing member is moved downward in response to the rotation of the elastic member when the dead bolt is locked.

Further, the door lock mortise may have a structure in which the latch fixing member is moved downward in response to the rotation of the elastic member when the dead bolt is unlocked, and the latch fixing member is moved upward in response to the rotation of the elastic member when the dead bolt is locked.

Further, the latch operating member may be in an operable state and the latch bolt may be in a movable state when the dead bolt is unlocked, and the latch operating member may be in a non-operable state and the latch bolt may be in a non-movable state when the dead bolt is locked.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 1 is a schematic view illustrating one surface of a door lock mortise in which a dead bolt is locked according to an embodiment of the present invention;

FIG. 2 is a schematic view illustrating one surface of the door lock mortise in which the dead bolt is unlocked according to an embodiment of the present invention;

FIG. 3 is a schematic view illustrating a back surface of the door lock mortise in which the dead bolt is locked of FIG. 1;

FIG. 4 is a schematic view illustrating a back surface of the door lock mortise in which the dead bolt is unlocked of FIG. 2;

FIG. 5 is a perspective view illustrating one surface of the door lock mortise in which the dead bolt is locked of FIG. 1; and FIG. 6 is a perspective view illustrating one surface of the door lock mortise in which the dead bolt is unlocked of FIG. 2.

DETAILED DESCRIPTION OF EXEMPLARY EMBODIMENTS

Hereinafter, detailed embodiments of the present invention will be described with reference to the drawings. The following detailed description is provided to facilitate a comprehensive understanding of methods, devices, and/or systems described in this specification. However, these are only examples, and the present invention is not limited thereto.

In a description of embodiments of the invention, when it is determined that detailed descriptions of known technology related to the present invention unnecessarily obscure the subject matter of the invention, the detailed descriptions will be omitted. Some terms described below are defined in consideration of functions in the invention, and meanings thereof may vary depending on, for example, a user or operator's intentions or customs. Therefore, the meanings of terms should be interpreted on the basis of the scope throughout this specification. The terminology used in the following detailed description is provided to only describe embodiments of the present invention and not for purposes of limitation. Unless the context clearly indicates otherwise, the singular forms include the plural forms. It should be understood that the terms "comprises" or "includes," when used herein, specify some features, numbers, steps, operations, elements, and/or combinations thereof, but do not preclude the presence or possibility of addition of one or more other features, numbers, steps, operations, elements, and/or combinations thereof in addition to those described.

FIG. 1 is a schematic view illustrating one surface of a door lock mortise in which a dead bolt is locked according to an embodiment of the present invention.

FIG. 2 is a schematic view illustrating one surface of the door lock mortise in which the dead bolt is unlocked according to the embodiment of the present invention.

First, referring to FIGS. 1 and 2, a door lock mortise 100 according to the embodiment of the present invention may include a latch bolt 110 inserted into a striker 210 of a door frame 200 to maintain a door (not illustrated) in a closed state, a latch operating member 120 rotatably operated to release the latch bolt 110, a latch cover member 130 formed to surround the latch bolt 110, and a latch operating member manipulating portion 140 which is rotated by an indoor or outdoor operating unit and rotates the latch operating member 120.

The closed state of the door may be achieved by a structure in which the latch bolt 110 is inserted into the striker 210 located in an inner space of the door frame 200. Conversely, a released state of the door may be achieved by the latch bolt 110, which is inserted into the striker 210, entering an inside of the door lock mortise 100.

Referring to FIG. 1, the latch operating member 120 has a structure in which one side surface thereof fixes one side surface of the latch bolt 110. Referring to FIG. 2, when the latch operating member 120 is rotated by manipulating the latch operating member manipulating portion 140, the latch operating member 120 is rotated counterclockwise such that the one side surface of the latch operating member 120 which is fixed the one side surface of the latch bolt 110 is deviated to move the latch bolt 110.

Further, the door lock mortise 100 may include a dead bolt 150 inserted into the striker 210 of the door frame 200 to maintain the door in a locked state, and a latch fixing member 160 which is moved between the latch operating member 120 and the latch cover member 130 when the dead bolt 150 is locked or unlocked.

In this case, the dead bolt 150 is rotated and unlocked by a dead bolt motor (not illustrated) when information for unlocking is input at an outdoor lever (authentication procedure). In such a structure, the dead bolt 150 may be inserted into the striker 210 of the door frame 200 when the dead bolt 150 is locked, as illustrated in FIG. 1, and the dead bolt 150 may enter the inside of the door lock mortise 100 when the dead bolt 150 is unlocked, as illustrated in FIG. 2.

In the structure, when the dead bolt 150 is unlocked, the latch fixing member 160 may be moved upward to allow the latch operating member 120 to be in an operable state and the latch bolt 110 to be in a movable state, and when the dead bolt 150 is locked, the latch fixing member 160 may be moved downward to allow the latch operating member 120 to be in a non-operable state and the latch bolt 110 to be in a non-movable state. In other words, the latch fixing member 160 may allow the rotation of the latch operating member 120 when the dead bolt 150 is unlocked and the latch fixing member 160 may inhibit the rotation of the latch operating member 120 when the dead bolt 150 is locked.

Therefore, since the latch bolt 110 is also in the non-movable state in a state in which the dead bolt 150 is locked, a problem in that an impact is transmitted only to the dead bolt 150 and durability of the dead bolt 150 is reduced may be addressed.

FIG. 3 is a schematic view illustrating a back surface of the door lock mortise in which the dead bolt is locked of FIG. 1.

FIG. 4 is a schematic view illustrating a back surface of the door lock mortise in which the dead bolt is unlocked of FIG. 2.

Referring to the drawings, the door lock mortise 100 may include a structure in which the latch fixing member 160 is inserted between the latch operating member 120 and the latch cover member 130 by being moved upward and downward, leftward and rightward, or backward and forward.

As described above, the structure for inserting the latch fixing member 160 between the latch operating member 120 and the latch cover member 130 is not limited to only being moved the upward and downward, leftward and rightward, or backward and forward, and the latch fixing member 160 may also be inserted between the latch operating member 120 and the latch cover member 130, for example, by being rotated.

The latch fixing member 160 includes, for example, an elastic member 170 having one end portion connected to the dead bolt 150 and the other end portion connected to the latch fixing member 160, and thus the latch fixing member 160 may be moved in response to the rotation of the elastic member 170 in communication with the movement of the dead bolt 150.

Specifically, the latch fixing member 160 may include a mounting portion 161 having a groove portion 162 into which a fixing member 180 passing through the dead bolt 150 is inserted, and a fixing portion 163 which extends to one side of the mounting portion 161 and is inserted between the latch operating member 120 and the latch cover member 130.

In this case, a shape of the fixing member 180 may be circular based on a cross section, and a shape of the groove portion 162 may be elliptical or rounded rectangular based on a cross section, but the present invention is not limited thereto.

The division of the mounting portion 161, the groove portion 162, and the fixing portion 163 of the latch fixing member 160 is for expressing a structure of an individual portion in which the latch fixing member 160 is mounted and operated in the door lock mortise 100, and does not express a structure in which the latch fixing member 160 is formed by separate members being combined.

The shape may be a shape capable of providing a space in which the latch fixing member 160 may be moved upward and downward, leftward and rightward, or backward and forward in a state in which the groove portion 162 is mounted on the fixing member 180 as a structure in which the latch fixing member 160 may be moved by upward and downward, leftward and rightward, or backward and forward in response to the movement of the elastic member 170.

In the above structure, the dead bolt 150 may be inserted and moved into the striker 210 of the door frame 200 when the dead bolt 150 is locked, the dead bolt 150 may enter into and move in a direction of the inside of the door lock mortise when the dead bolt 150 is unlocked, one end portion of the elastic member 170 located at the dead bolt 150 in a non-fixed state may be rotated clockwise or counterclockwise, and the latch fixing member 160 in which the other end portion of the elastic member 170 is located may be moved upward and downward in response to the rotation of the elastic member 170.

In this case, the dead bolt 150 may include a first locking protrusion portion 151 and a second locking protrusion portion 152 which are in contact with the one end portion of the elastic member 170. The elastic member 170 may be rotated by the movement of the first locking protrusion portion 151 when the dead bolt 150 is unlocked, as illustrated in FIG. 4, and, conversely, the elastic member 170 may be rotated by the movement of the second locking protrusion portion 152 when the dead bolt 150 is locked, as illustrated in FIG. 3.

Therefore, the latch fixing member 160 may be moved upward in response to the rotation of the elastic member 170 when the dead bolt 150 is unlocked, and may be moved downward in response to the rotation of the elastic member 170 when the dead bolt 150 is locked.

Conversely, when the latch fixing member 160 is located at a lower position relative to the latch operating member 120 and the latch cover member 130, the latch fixing member 160 may be moved downward in response to the rotation of the elastic member 170 when the dead bolt 150 is unlocked, and may be moved upward in response to the rotation of the elastic member 170 when the dead bolt 150 is locked, and thus the latch fixing member 160 may be variously moved according to a specific position or shape at which the latch fixing member 160 is applied.

Meanwhile, the door lock mortise 100 may include a structure in which the elastic member 170 is inserted into the fixing member 180 like the latch fixing member 160, and may include, for example, a torsion spring, but the present invention is not limited thereto.

FIG. 5 is a perspective view illustrating one surface of the door lock mortise in which the dead bolt is locked of FIG. 1.

FIG. 6 is a perspective view illustrating one surface of the door lock mortise in which the dead bolt is unlocked of FIG. 2.

As described above, the door lock mortise 100 may include a structure in which the latch fixing member 160 is moved upward in response to the rotation of the elastic member 170 when the dead bolt 150 enters and moves thereinto, and is moved downward in response to the rotation of the elastic member 170 when the dead bolt 150 protrudes and moves therefrom.

Referring to the drawings along with FIGS. 3 and 4, the door lock mortise 100 may include a structure in which the fixing portion 163 of the latch fixing member 160 is inserted into a space between the latch operating member 120 and the latch cover member 130.

Specifically, the fixing portion 163 (see FIG. 3) may include a parallel portion 164 which is not in contact with one end portion of the latch cover member 130, and a locking portion 165 which protrudes between the latch operating member 120 and the latch cover member 130 to be perpendicular to the parallel portion 164.

Therefore, as illustrated in FIG. 6, the door lock mortise 100 may include a structure in which when the dead bolt 150 is unlocked, the latch fixing member 160 is moved upward in response to the rotation of the elastic member 170 so that the locking portion 165 is not located between the latch operating member 120 and the latch cover member 130, which is a structure in which the latch operating member 120 is normally operated. Conversely, as illustrated in FIG. 5, the door lock mortise 100 may include a structure in which when the dead bolt 150 is locked, the latch fixing member 160 is moved downward in response to the rotation of the elastic member 170 and the locking portion 165 is positioned between the latch operating member 120 and the latch cover member 130, which is a structure in which the latch operating member 120 enters into the non-operable state.

That is, the locking portion 165 may not transmit the rotation of the latch operating member 120 to the latch cover member 130, and may intervene in a rotational space of the latch operating member 120 to limit the rotation of the latch operating member 120.

According to the embodiments of the present invention, since the door lock mortise includes a structure in which the latch fixing member moves between the latch operating member and the latch cover member when the dead bolt is locked or unlocked, a problem in that the latch bolt can be moved when the dead bolt is unlocked to release the door lock so that an impact is transmitted only to the dead bolt in a state in which the dead bolt is not unlocked, and durability is reduced can be addressed.

While representative embodiments of the preset invention have been described above in detail, it should be understood by those skilled in the art that the embodiments may be variously modified without departing from the scope of the present invention. Therefore, the scope of the present invention is defined not by the described embodiment but by the appended claims, and encompasses equivalents that fall within the scope of the appended claims.

What is claimed is:

1. A door lock mortise comprising:

a latch bolt configured to be inserted into a striker plate of a door frame and configured to maintain a door in a closed state;

a latch operating member configured to be rotatably operated to release the latch bolt from the striker plate;

a latch cover member formed to surround the latch bolt;

a latch operating member manipulating portion configured to be rotated by an indoor or outdoor operating unit and configured to rotate the latch operating member;

a dead bolt configured to be inserted into the striker plate of the door frame and configured to maintain the door in a locked state; and a latch fixing member configured to be inserted between the latch operating member and the latch cover member in response to the dead bolt being locked and removed from between the latch operating member and the latch cover member in response to the dead bolt being unlocked, wherein, in response to the dead bolt being locked, the latch fixing member is inserted between the latch operating member and the latch cover member, such that the latch fixing member intervenes in a rotational space of the latch operating member to inhibit the rotation of the latch operating member.

2. The door lock mortise of claim 1, wherein the latch fixing member is further configured to be inserted between the latch operating member and the latch cover member by being moved upward and downward, leftward and rightward, or backward and forward.

3. The door lock mortise of claim 1, wherein the latch fixing member is further configured to be inserted between the latch operating member and the latch cover member by being rotated.

4. The door lock mortise of claim 2, wherein the latch fixing member comprises:

a mounting portion having a groove portion into which a fixing member passing through the dead bolt is inserted; and a fixing portion configured to extend to one side of the mounting portion and further configured to be inserted and removed from between the latch operating member and the latch cover member.

5. The door lock mortise of claim 4, wherein the fixing portion comprises:

a parallel portion configured not to contact one end portion of the latch cover member; and a locking portion configured to protrude between the latch operating member and the latch cover member, the locking portion being provided perpendicular to the parallel portion.

6. The door lock mortise of claim 1, wherein:

the dead bolt is further configured to be inserted and moved into the striker plate of the door frame in response to the dead bolt being locked, and to enter into and move in a direction of an inside of the door lock mortise in response to the dead bolt being unlocked;

one end portion of an elastic member located at the dead bolt in a non-fixed state is configured to rotate clockwise or counterclockwise; and the latch fixing member in which the other end portion of the elastic member is located is further configured to be moved upward and downward in response to rotation of the elastic member.

7. The door lock mortise of claim 6, wherein:

the dead bolt comprises a first locking protrusion portion and a second locking protrusion portion configured to contact the one end portion of the elastic member;

the elastic member is configured to be rotated by movement of the first locking protrusion portion in response to the dead bolt being unlocked; and the elastic member is further configured to be rotated by movement of the second locking protrusion portion in response to the dead bolt being locked.

8. The door lock mortise of claim 7, wherein:

the latch fixing member is further configured to be moved upward in response to the rotation of the elastic member when the dead bolt is unlocked; and the latch fixing member is further configured to be moved downward in response to the rotation of the elastic member when the dead bolt is locked.

9. The door lock mortise of claim 7, wherein:

the latch fixing member is further configured to be moved downward in response to the rotation of the elastic member when the dead bolt is unlocked; and the latch fixing member is further configured to be moved upward in response to the rotation of the elastic member when the dead bolt is locked.

10. The door lock mortise of claim 1, wherein:

the latch operating member is in an operable state and the latch bolt is in a movable state in response to the dead bolt being unlocked; and the latch operating member is in a non-operable state and the latch bolt is in a non-movable state in response to the dead bolt being locked.

11. A door lock mortise comprising:

a latch bolt configured to extend from an edge of a door into a striker plate and to retract into a pocket provided in the edge of the door, the striker plate being provided on a doorjamb;

a dead bolt configured to extend into the striker plate and to retract into the pocket;

a latch operating member configured to rotate to cause the latch bolt to extend and retract; and a latch fixing member configured to, in response to the dead bolt extending from the edge of the door into the striker plate, intervene in a rotational space of the latch operating member to inhibit rotation of the latch operating member, wherein:

the latch fixing member comprises a fixing portion that is movable between a fixing state and a releasing state;

in the fixing state, the fixing portion is provided at a first position between the latch operating member and a cover surrounding the latch bolt; and in the releasing state, the fixing portion is provided at a second position other than between the latch operating member and the cover surrounding the latch bolt.

12. The door lock mortise of claim 11, wherein:

the fixing portion is configured to move to the fixing state in response to the dead bolt extending into the striker plate; and the fixing portion is configured to move to the releasing state in response to the dead bolt retracting into the pocket.

13. The door lock mortise of claim 11, further comprising an elastic member connected to the dead bolt and the latch fixing member, wherein the elastic member is configured to rotate in response to protrusion of the dead bolt, wherein the latch fixing member is further configured to move to a position which inhibits the rotation of the latch operating member in response to rotation of the elastic member.

14. The door lock mortise of claim 13, wherein a fixing rod passing through the dead bolt is inserted into a notch provided on the latch fixing member, and wherein the fixing rod is coupled to the elastic member such that the latch fixing member moves relative to the fixing rod in response to rotation of the elastic member.

* * * * *